US010144883B2

(12) United States Patent
Konda et al.

(10) Patent No.: US 10,144,883 B2
(45) Date of Patent: Dec. 4, 2018

(54) APPARATUSES AND METHODS FOR DESULFURIZATION OF NAPHTHA

(71) Applicant: UOP LLC, Des Plaines, IL (US)

(72) Inventors: Sarathsatyakalyan Konda, Mumbai (IN); Krishnan Vaidyanathan, Dubai (AE); Venkat Ram Naidu Pandranki, Gurgaon (IN)

(73) Assignee: UOP LLC, Des Plaines, IL (US)

( * ) Notice: Subject to any disclaimer, the term of this patent is extended or adjusted under 35 U.S.C. 154(b) by 664 days.

(21) Appl. No.: 14/080,233

(22) Filed: Nov. 14, 2013

(65) Prior Publication Data

US 2015/0129462 A1 May 14, 2015

(51) Int. Cl.

| | |
|---|---|
| ***C10G 65/00*** | (2006.01) |
| ***C10G 65/06*** | (2006.01) |
| ***C10G 45/02*** | (2006.01) |
| ***C10G 45/32*** | (2006.01) |
| ***C10G 65/04*** | (2006.01) |

(52) U.S. Cl.

CPC ..... *C10G 65/06* (2013.01); *C10G 45/02* (2013.01); *C10G 45/32* (2013.01); *C10G 65/04* (2013.01)

(58) Field of Classification Search

CPC ..... C10G 65/04; C10G 65/06; C10G 45/02; C10G 45/32

See application file for complete search history.

(56) References Cited

U.S. PATENT DOCUMENTS

| | | | |
|---|---|---|---|
| 5,500,108 | A | 3/1996 | Durand et al. |
| 6,083,378 | A | 7/2000 | Gildert et al. |
| 6,387,249 | B1 | 5/2002 | Cook et al. |
| 6,416,658 | B1 | 7/2002 | Maraschino et al. |
| 6,913,688 | B2 | 7/2005 | Coker et al. |
| 7,291,258 | B2 | 11/2007 | Podrebarac et al. |

(Continued)

FOREIGN PATENT DOCUMENTS

| | | | |
|---|---|---|---|
| CN | 102899083 | A | 1/2013 |
| FR | 2875809 | A1 | 3/2006 |

OTHER PUBLICATIONS

Melpolder et al., Composition of Naphtha from Fluid Catalytic Cracking, Ind. Eng. Chem., May 1952, 44 (5), pp. 1142-1146.*

(Continued)

*Primary Examiner* — Prem C Singh
*Assistant Examiner* — Brandi M Doyle

(57) ABSTRACT

Embodiments of apparatuses and methods for desulfurization of naphtha are provided. In one example, a method comprises fractionating a partially hydrodesulfurized, olefin-enriched naphtha stream in a first vapor-liquid contacting chamber to form a partially hydrodesulfurized, $H_2S$-depleted, olefin-enriched naphtha stream. The partially hydrodesulfurized, $H_2S$-depleted, olefin-enriched naphtha stream is contacted with a hydrotreating catalyst to form an additionally hydrodesulfurized, olefin-enriched naphtha stream. The additionally hydrodesulfurized, olefin-enriched naphtha stream is fractionated in a second vapor-liquid contacting chamber to form a hydrodesulfurized, $H_2S$-depleted, olefin-enriched naphtha product stream. The first and second vapor-liquid contacting chambers are enclosed in a split shell stripper vessel and separated by a dividing wall.

11 Claims, 1 Drawing Sheet

(56) References Cited

U.S. PATENT DOCUMENTS

| | | | | |
|---|---|---|---|---|
| 7,361,265 | B2 | 4/2008 | de Almeida et al. | |
| 7,422,679 | B2 | 9/2008 | Ellis et al. | |
| 7,507,328 | B2 | 3/2009 | Ellis et al. | |
| 8,288,305 | B2 | 10/2012 | Bai et al. | |
| 2002/0002315 | A1* | 1/2002 | Kelly | C07C 7/163 585/259 |
| 2005/0252831 | A1* | 11/2005 | Dysard | C10G 45/08 208/212 |
| 2006/0076271 | A1 | 4/2006 | Bournay et al. | |
| 2006/0096893 | A1* | 5/2006 | De Almeida | C10G 45/02 208/210 |
| 2007/0012596 | A1 | 1/2007 | Picard et al. | |
| 2007/0114156 | A1 | 5/2007 | Greeley et al. | |
| 2007/0246399 | A1 | 10/2007 | Picard et al. | |
| 2009/0101545 | A1 | 4/2009 | Picard et al. | |
| 2009/0223866 | A1 | 9/2009 | Bhan | |
| 2012/0048776 | A1 | 3/2012 | Podrebarac et al. | |
| 2012/0080356 | A1* | 4/2012 | Petri | C10G 65/04 208/49 |
| 2013/0118952 | A1* | 5/2013 | Greeley | C10G 59/02 208/89 |

OTHER PUBLICATIONS

Surinder Parkash, Refining Processes Handbook, Chapter 2 Distillate Hydrotreating (Elsevier 2003).*

Leonard, et al., "Recombination: A Complicating Issue in FCC Naphtha Desulfurization," 2006 AlChE Spring Annual Meeting, 2006, ISBN-10: 0816910057, ISBN-13: 9780816910052, Conference: 2006 AlChE Spring National Meeting, Apr. 23, 2006-Apr. 27, 2006, American Institute of Chemical Engineers.

Leonard, et al., "Thiol Formation and Conversion in FCC Naphtha Desulfurization," ACS National Meeting Book of Abstracts, v 232, 1p, 2006, ISSN: 00657727, ISBN-10: 0841274266, ISBN-13: 9780841274266, Conference: 232nd American Chemical Society Meeting and Exposition, Sep. 10, 2006-Sep. 14, 2006.

"Catalyst Review: UOP LLC, A Honeywell Company," Hydrocarbon Engineering, v 15, n. 1, p. 60, Jan. 2010, ISSN: 14689340, Palladian Publications.

* cited by examiner

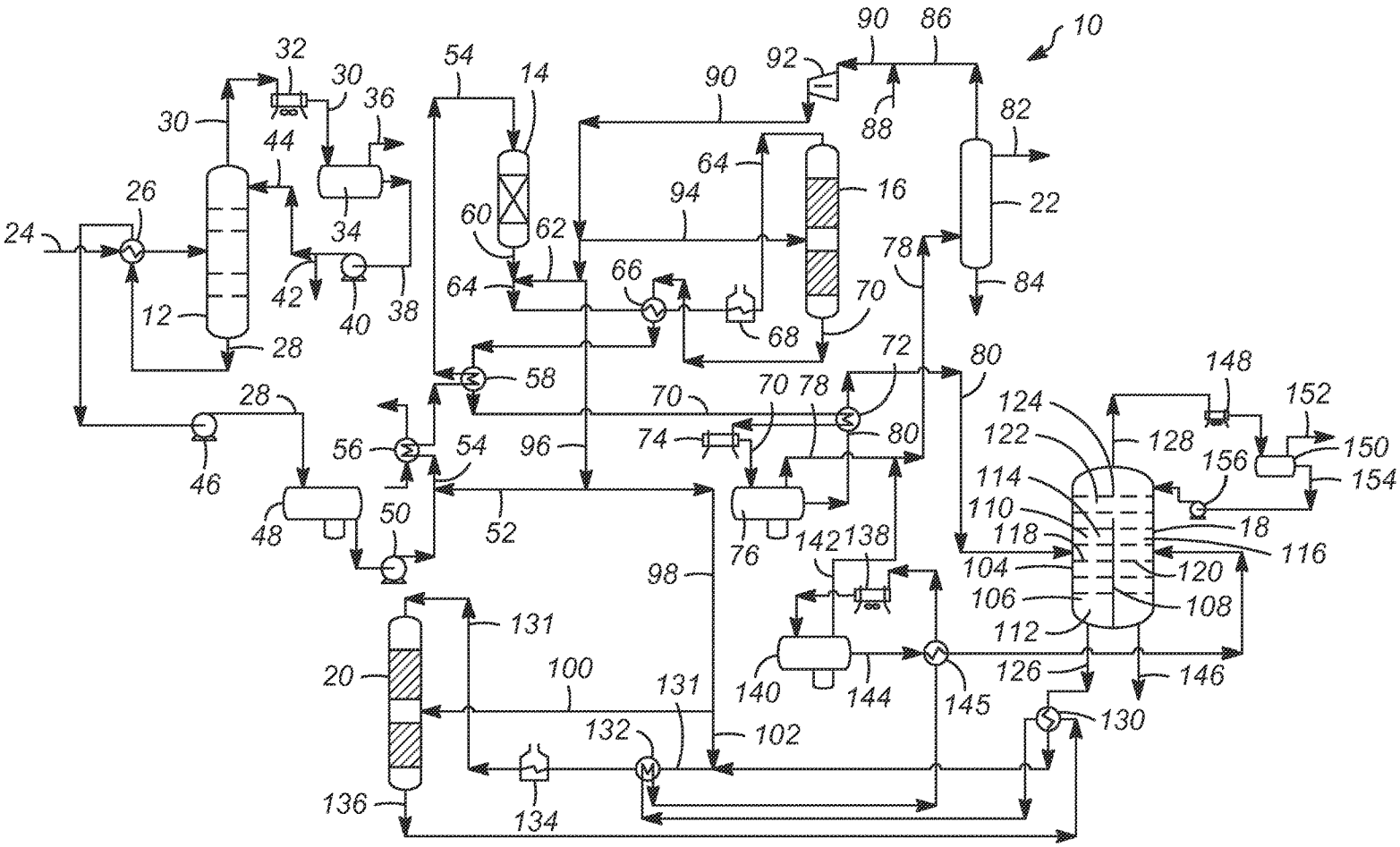

APPARATUSES AND METHODS FOR DESULFURIZATION OF NAPHTHA

TECHNICAL FIELD

The technical field relates generally to apparatuses and methods for desulfurization of naphtha, and more particularly relates to apparatuses and methods for desulfurization of naphtha while substantially preserving or enriching the olefin content of the naphtha.

BACKGROUND

Environmental regulations mandate the lowering of sulfur levels in motor gasoline (mogas), for example, to 10 ppm or less. In many cases, lower sulfur levels for mogas can be achieved by hydrotreating naphtha produced from Fluid Catalytic Cracking (FCC), which is a significant contributor to sulfur in the mogas pool. Additionally, since sulfur in mogas can also lead to decreased performance of catalytic converters, a 10 ppm or less sulfur target is desirable even in cases where regulations would permit higher levels.

Conventional fixed bed hydrotreating is used to desulfurize (remove sulfur from) naphtha to reduce the sulfur content to very low levels. However, such hydrotreating also results in significant octane number loss due to extensive reduction of the olefin content in the naphtha. Techniques are needed to reduce not only the sulfur level in naphtha but also to minimize or eliminate the reduction of beneficial properties such as octane number preferably while minimizing additional equipment and/or operational cost.

Accordingly, it is desirable to provide apparatuses and methods for desulfurization of naphtha while substantially preserving or enriching the olefin content of the naphtha. Additionally, it is desirable to provide apparatuses and methods for desulfurization of naphtha while minimizing additional equipment and/or operational cost. Furthermore, other desirable features and characteristics of the present invention will become apparent from the subsequent detailed description and the appended claims, taken in conjunction with the accompanying drawings and this background.

BRIEF SUMMARY

Apparatuses and methods for desulfurization of naphtha are provided herein. In accordance with an exemplary embodiment, a method for desulfurization of naphtha comprises the steps of fractionating a partially hydrodesulfurized, olefin-enriched naphtha stream in a first vapor-liquid contacting chamber to form a partially hydrodesulfurized, $H_2S$-depleted, olefin-enriched naphtha stream. The partially hydrodesulfurized, $H_2S$-depleted, olefin-enriched naphtha stream is contacted with a hydrotreating catalyst in the presence of hydrogen at hydroprocessing conditions effective to form an additionally hydrodesulfurized, olefin-enriched naphtha stream. The additionally hydrodesulfurized, olefin-enriched naphtha stream is fractionated in a second vapor-liquid contacting chamber to form a hydrodesulfurized, $H_2S$-depleted, olefin-enriched naphtha product stream. The first and second vapor-liquid contacting chambers are enclosed in a split shell stripper vessel and separated by a dividing wall.

In accordance with another exemplary embodiment, a method for desulfurization of naphtha is provided. The method comprises the steps of contacting a naphtha feed stream that comprises sulfur, $C_6$-$C_{12}$ hydrocarbons, olefins, aromatics, and di-olefins with a di-olefin hydroprocessing catalyst in the presence of hydrogen at hydrogenation conditions effective to convert di-olefins to olefins and form an olefin-enriched naphtha stream. The olefin-enriched naphtha stream is advanced into a first hydrotreating reactor that contains a first hydrotreating catalyst in the presence of hydrogen and that is operating at first hydroprocessing conditions effective to convert a quantity of sulfur into $H_2S$ and form a partially hydrodesulfurized, olefin-enriched naphtha stream. The partially hydrodesulfurized, olefin-enriched naphtha stream is introduced to a first vapor-liquid contacting chamber of a split shell stripper vessel for fractionation to form a partially hydrodesulfurized, $H_2S$-depleted, olefin-enriched naphtha stream. The partially hydrodesulfurized, $H_2S$-depleted, olefin-enriched naphtha stream is advanced into a second hydrotreating reactor that contains a second hydrotreating catalyst in the presence of hydrogen and that is operating at second hydroprocessing conditions effective to convert an additional quantity of sulfur to $H_2S$ and form an additionally hydrodesulfurized, olefin-enriched naphtha stream. The additionally hydrodesulfurized, olefin-enriched naphtha stream is introduced to a second vapor-liquid contacting chamber of the split shell stripper vessel for fractionation to form a hydrodesulfurized, $H_2S$-depleted, olefin-enriched naphtha product stream. The first and second vapor-liquid contacting chambers are separated by a dividing wall that extends vertically in an internal volume enclosed by the split shell stripper vessel.

In accordance with another exemplary embodiment, an apparatus for desulfurization of naphtha is provided. The apparatus comprises a first hydrotreating reactor. The first hydrotreating reactor is configured for contacting an olefin-enriched naphtha stream with a first hydrotreating catalyst in the presence of hydrogen at first hydroprocessing conditions effective to form a partially hydrodesulfurized, olefin-enriched naphtha stream. A split shell stripper vessel is in fluid communication with the first hydrotreating reactor. The split shell stripper vessel comprises a cylindrical wall that extends vertically and that encloses an internal volume having a central portion extending downward to a lower portion. A dividing wall extends vertically through the internal volume to divide the lower and central portions into a first vapor-liquid contacting chamber and a second vapor-liquid contacting chamber. The first vapor-liquid contacting chamber is configured for receiving and fractionating the partially hydrodesulfurized, olefin-enriched naphtha stream to form a partially hydrodesulfurized, $H_2S$-depleted, olefin-enriched naphtha stream. A second hydrotreating reactor is in fluid communication with the split shell stripper vessel. The second hydrotreating reactor is configured for contacting the partially hydrodesulfurized, $H_2S$-depleted, olefin-enriched naphtha stream with a second hydrotreating catalyst in the presence of hydrogen at second hydroprocessing conditions effective to form an additionally hydrodesulfurized, olefin-enriched naphtha stream. The second vapor-liquid contacting chamber is configured for receiving and fractionating the additionally hydrodesulfurized, olefin-enriched naphtha stream to form a hydrodesulfurized, $H_2S$-depleted, olefin-enriched naphtha product stream.

BRIEF DESCRIPTION OF THE DRAWINGS

The various embodiments will hereinafter be described in conjunction with the following drawing figures, wherein like numerals denote like elements, and wherein:

FIG. 1 schematically illustrates an apparatus and method for desulfurization of naphtha in accordance with an exemplary embodiment.

DETAILED DESCRIPTION

The following Detailed Description is merely exemplary in nature and is not intended to limit the various embodiments or the application and uses thereof Furthermore, there is no intention to be bound by any theory presented in the preceding background or the following detailed description.

Various embodiments contemplated herein relate to apparatuses and methods for desulfurization of naphtha. The exemplary embodiments taught herein provide a naphtha feed stream that is introduced to a di-olefin hydroprocessing reactor. The naphtha feed stream comprises sulfur, $C_6$-$C_{12}$ hydrocarbons, olefins, aromatics, and di-olefins. As used herein, the term "naphtha" refers to a middle boiling range hydrocarbon fraction or fractions that are major components of gasoline. In an exemplary embodiment, naphtha includes hydrocarbons (e.g., $C_6$-$C_{12}$ hydrocarbons and various olefins, aromatics, and di-olefins) having boiling points at atmospheric pressure of from about 10 to about 232° C., for example from about 21 to about 221° C. As used herein, $C_X$ means hydrocarbon molecules that have "X" number of carbon atoms, $C_X^+$ means hydrocarbon molecules that have "X" and/or more than "X" number of carbon atoms, and $C_X^-$ means hydrocarbon molecules that have "X" and/or less than "X" number of carbon atoms. As used herein, the term "olefin" refers to a class of unsaturated aliphatic hydrocarbons having only one carbon-carbon double bond, e.g., alkenes such as ethylene, polyethylene, butylene, and the like. As used herein, the term "di-olefin" refers to a class of unsaturated aliphatic hydrocarbons having only two carbon-carbon double bonds, e.g., dienes such as 1,3-butadiene and the like.

The di-olefin hydroprocessing reactor utilizes a di-olefin hydroprocessing catalyst in the presence of hydrogen and operates at hydrogenation conditions. The naphtha feed stream contacts the di-olefin hydroprocessing catalyst to partially saturate (e.g., partially hydrogenate) and convert di-olefins to olefins, thereby enriching the stream with olefins to form an olefin-enriched naphtha stream. In an exemplary embodiment, the olefin-enriched naphtha stream comprises sulfur, $C_6$-$C_{12}$ hydrocarbons, olefins, and aromatics. It has been found that di-olefins tend to polymerize at elevated temperatures and by converting the di-olefins to olefins, the olefin-enriched naphtha stream is not only enriched with olefins to help preserve or improve the octane number of the downstream products) but also has a composition that is more robust to more severe processing conditions including higher processing temperatures, such as, for example, of about 140° C. or greater.

The olefin-enriched naphtha stream is advanced into a first stage hydrotreating reactor that contains a hydrotreating catalyst in the presence of hydrogen and that is operating at hydroprocessing conditions. In an exemplary embodiment, the hydroprocessing conditions include a temperature of from about 250 to about 300° C. The olefin-enriched naphtha stream contacts the hydrotreating catalyst to partially hydrodesulfurized (removing sulfur by combining sulfur with hydrogen to form hydrogen sulfide ($H_2S$)) the olefin-enriched naphtha stream to form a partially hydrodesulfurized, olefin-enriched naphtha stream. In particular, some of the sulfur contained in the olefin-enriched naphtha stream reacts with hydrogen to form $H_2S$. In an exemplary embodiment, the partially hydrodesulfurized, olefin-enriched naphtha stream comprises a remaining quantity of sulfur, $H_2S$, $C_6$-$C_{12}$ hydrocarbons, olefins, and aromatics.

The partially hydrodesulfurized-olefin-enriched naphtha stream is passed along and introduced to a split shell stripper vessel. The split shell stripper vessel encloses an internal volume and has a dividing wall that extends vertically through the internal volume to divide the internal volume into a first vapor-liquid contacting chamber and a second vapor-liquid contacting chamber. In an exemplary embodiment, the first and second liquid-vapor contacting chambers each contain a vapor-liquid contacting device that may be in the form of packing, or alternatively, in the form of fractionation trays for fractional distillation. The partially hydrodesulfurized, olefin-enriched naphtha stream is advanced into the first vapor-liquid contacting chamber and is fractionated via contact with the corresponding vapor-liquid contacting device to remove $H_2S$ and form a partially hydrodesulfurized, $H_2S$-depleted, olefin-enriched naphtha stream. In an exemplary embodiment, the partially hydrodesulfurized, $H_2S$-depleted, olefin-enriched naphtha stream is substantially depleted of $H_2S$ and comprises a remaining quantity of sulfur, $C_6$-$C_{12}$ hydrocarbons, olefins, and aromatics.

The partially hydrodesulfurized, $H_2S$-depleted, olefin-enriched naphtha stream is passed along to a second stage hydrotreating reactor. The second stage hydrotreating reactor contains a hydrotreating catalyst in the presence of hydrogen and is operating at hydroprocessing conditions. In an exemplary embodiment, the hydroprocessing conditions include a temperature of from about 250 to about 300° C. The partially hydrodesulfurized, $H_2S$-depleted, olefin-enriched naphtha stream contacts the hydrotreating catalyst and at least a substantial portion of the remaining quantity of sulfur in the stream is converted to $H_2S$ to form an additionally hydrodesulfurized, olefin-enriched naphtha stream. In an exemplary embodiment, the additionally hydrodesulfurized, olefin-enriched naphtha stream is substantially depleted of sulfur and comprises $H_2S$, $C_6$-$C_{12}$ hydrocarbons, olefins, and aromatics.

The additionally hydrodesulfurized, olefin-enriched naphtha stream is introduced to the split shell stripper vessel and advanced into the second vapor-liquid contacting chamber. The additionally hydrodesulfurized, olefin-enriched naphtha stream is fractionated in the second vapor-liquid contacting chamber via contact with the corresponding contacting device to remove $H_2S$ and form a hydrodesulfurized, $H_2S$-depleted, olefin-enriched naphtha product stream. In an exemplary embodiment, the hydrodesulfurized, $H_2S$-depleted, olefin-enriched naphtha product stream is substantially depleted of sulfur and $H_2S$, and comprises $C_6$-$C_{12}$ hydrocarbons, olefins, and aromatics. It has been found that by using two separate hydrotreating reactors, specifically the first and second stage hydrotreating reactors, to hydrodesulfurized the olefin-enriched naphtha stream, the hydrotreating reactors can be operated at less severe operating conditions (e.g., lower temperatures) than a single larger capacity hydrotreating reactor that otherwise may cause saturation and loss of olefins. As such, the olefin content of the olefin-enriched naphtha stream is substantially preserved during hydrodesulfurization. Moreover, by using a single split shell stripper vessel for subsequent downstream removal of the $H_2S$ from the two separate hydrodesulfurized, olefin-enriched naphtha streams (e.g., the partially hydrodesulfurized, olefin-enriched naphtha stream and the additionally hydrodesulfurized, olefin-enriched naphtha stream), additional equipment and/or operational cost is minimized.

FIG. 1 schematically illustrates an apparatus 10 for desulfurization of naphtha in accordance with an exemplary embodiment. The apparatus 10 comprises a naphtha splitter 12, a di-olefin reactor 14, a first stage hydrotreating reactor 16, a split shell stripper vessel 18, a second stage hydrotreating reactor 20, and a recycle gas scrubber 22 that are in fluid communication with each other. As illustrated, a naphtha feed 24 is introduced to the apparatus 10. As discussed above, the naphtha feed 24 comprises sulfur, $C_6$-$C_{12}$ hydrocarbons, olefins, aromatics, di-olefins, and some $C_5$ hydrocarbons.

As illustrated, the naphtha feed 24 is passed through a heat exchanger 26 and advanced to the naphtha splitter 12. In an exemplary embodiment, the naphtha feed 24 is introduced to the naphtha splitter 12 at a temperature of from about 120 to about 150° C. The naphtha feed 24 is separated in the naphtha splitter 12 to form a naphtha feed stream 28 and a $C_6^-$ hydrocarbons stream 30. The naphtha feed stream 28 comprises $C_6$-$C_{12}$ hydrocarbons, olefins, aromatics, and di-olefins, and the $C_6^-$ hydrocarbons stream 30 comprises some $C_6^+$ hydrocarbons, $C_4$-$C_5$ hydrocarbons, and $C_1$-$C_3$ hydrocarbons. In an exemplary embodiment, the naphtha feed stream 28 has a temperature of from about 150 to about 180° C. and the $C_6^-$ hydrocarbons stream 30 has a temperature of from about 60 to about 90° C.

As illustrated, the $C_6^-$ hydrocarbons stream 30 is passed through a cooler 32 and advanced to a vent separator vessel 34. In an exemplary embodiment, the $C_6$ hydrocarbons stream 30 is introduced to the vent separator vessel 34 at a temperature of from about 40 to about 60° C. The $C_6^-$ hydrocarbons stream 30 is separated in the vent separator vessel 34 to form an offgas stream 36 that comprises $C_1$-$C_3$ hydrocarbons and a liquid stream 38 that comprises some $C_6^+$ hydrocarbons and $C_4$-$C_5$ hydrocarbons. The liquid stream 38 is passed through a pump 40 and separated into a $C_4$-$C_6$ hydrocarbons stream 42 and a $C_6^+$ hydrocarbons stream 44 that is recycled back to the naphtha splitter 12.

The naphtha feed stream 28 is passed through the heat exchanger 26 for indirect heat exchange with the naphtha feed 24. In an exemplary embodiment, the naphtha feed stream 28 is cooled via the heat exchanger 26 to a temperature of from about 110 to about 130° C. As illustrated, the naphtha feed stream 28 is passed through a pump 46, a feed surged drum 48, a pump 50 and a $H_2$ rich stream 52 is introduced to the naphtha feed stream 28 to form a combined feed stream 54. The combined feed stream 54 is passed through heat exchangers 56 and 58 and advanced to the di-olefin reactor 14. In an exemplary embodiment, the combined feed stream 54 is introduced to the di-olefin reactor 14 at a temperature of from about 130 to about 180° C.

The di-olefin reactor 14 contains a di-olefin hydroprocessing catalyst. Di-olefin hydroprocessing catalysts are well known and typically comprise cobalt (Co) and/or molybdenum (Mo) and have relatively low activity so as to partially saturate (partially hydrogenate) di-olefins in the presence of hydrogen to convert di-olefins to olefins without substantially saturating or hydrogenating the olefins. In an exemplary embodiment, the di-olefin reactor 14 is operating at hydrogenation conditions that include a temperature of from about 130 about 180° C. In the di-olefin reactor 14, the combined feed stream 54 contacts the di-olefin hydroprocessing catalyst to convert di-olefins from the naphtha feed stream 28 to olefins to form an olefin-enriched naphtha stream 60. In an exemplary embodiment, the olefin-enriched naphtha stream 60 comprises sulfur, $C_6$-$C_{12}$ hydrocarbons, olefins, and aromatics. In an exemplary embodiment, the olefin-enriched naphtha stream 60 has a temperature of from about 140 to about 190° C.

The olefin-enriched naphtha stream 60 exits the di-olefin reactor 14 and is combined with a $H_2$ rich stream 62 to form a combined stream 64. The combined stream 64 is passed through a heat exchanger 66 and a heater 68 and is advanced to the first stage hydrotreating reactor 16. In an exemplary embodiment, the combined stream 64 is introduced to the first stage hydrotreating reactor 16 at a temperature of from about 250 to about 300° C.

The first stage hydrotreating reactor 16 contains a hydrotreating catalyst. Hydrotreating catalysts are well known and typically comprise molybdenum (Mo), tungsten (W), cobalt (Co), and/or nickel (Ni) on a support comprised of γ-alumina. In an exemplary embodiment, the first stage hydrotreating reactor 16 is operating at hydroprocessing conditions that include a temperature of from about 250 to about 300° C. In the first stage hydrotreating reactor 16, the combined stream 64 and a $H_2$ rich stream 94 contact the hydrotreating catalyst to convert some of the sulfur from the olefin-enriched naphtha stream 60 to $H_2S$ (e.g., via combining the sulfur with hydrogen) to form a partially hydrodesulfurized, olefin-enriched naphtha stream 70. Additionally, any nitrogen or nitrogen containing compounds that may be present in the combined stream 64 (e.g., originally present in the naphtha feed 24) may be combined with hydrogen to form amines. In an exemplary embodiment, the partially hydrodesulfurized, olefin-enriched naphtha stream 70 comprises a remaining quantity of sulfur, $H_2S$, $C_6$-$C_{12}$ hydrocarbons, olefins, aromatics, and some amines. In an exemplary embodiment, the partially hydrodesulfurized, olefin-enriched naphtha stream 70 has a temperature of from about 255 to about 305° C.

The partially hydrodesulfurized, olefin-enriched naphtha stream 70 exits the first stage hydrotreating reactor 16 and is passed through the heat exchangers 66 and 58 for indirect heat exchange with the combined streams 64 and the combined feed stream 54, respectively, and further through a heat exchanger 72 and a cooler 74 for introduction to a cold separator vessel 76. In an exemplary embodiment, the partially hydrodesulfurized, olefin-enriched naphtha stream 70 is introduced to the cold separator vessel 76 at a temperature of from about 35 to about 60° C. Light ends such as $H_2$, $C_1$-$C_2$ hydrocarbons, and amines are removed from the partially hydrodesulfurized, olefin-enriched naphtha stream 70 to form a gas stream 78 and the partially hydrodesulfurized, olefin-enriched naphtha stream 80.

As illustrated, the gas stream 78 is advanced from the cold separator vessel 76 to the recycle gas scrubber 22. In the recycle gas scrubber 22, amines are separated from the gas stream 78 to form a lean amines stream 82, a rich amine stream 84, and a $H_2$, $C_1$-$C_2$ containing gas stream 86. A $H_2$ make-up gas stream 88 is introduced to the $H_2$, $C_1$-$C_2$ containing gas stream 86 to form a $H_2$ rich stream 90. The $H_2$ rich stream 90 is passed through a recycle gas compressor 92 and is divided into $H_2$ rich streams 52, 62, 94, 96, 98, 100, and 102.

As illustrated, the partially hydrodesulfurized, olefin-enriched naphtha stream 80 is removed from the cold separator vessel 76 and is passed through a heat exchanger 72 for indirect heat exchange with the partially hydrodesulfurized, olefin-enriched naphtha stream 70 and is advanced to the split shell stripper vessel 18. In an exemplary embodiment, the partially hydrodesulfurized, olefin-enriched naphtha stream 80 is introduced to the split shell stripper vessel 18 at a temperature of from about 120 about 145° C.

In an exemplary embodiment, the split shell stripper vessel 18 has a cylindrical wall 104 that extends vertically and that encloses an internal volume 106. As illustrated, the split shell stripper vessel 18 is configured as a dividing wall fractionation column and has a dividing wall 108 that extends vertically through a central portion 110 and a lower portion 112 of the internal volume 106. The dividing wall 108 divides the central and lower portions 110 and 112 into a vapor-liquid contacting chamber 114 and a vapor-liquid contacting chamber 116. As illustrated, each of the vapor-liquid contacting chambers 114 and 116 comprise a plurality of fractionation trays 118 and 120 that are arranged along the dividing wall 108 as a contacting device for fractional distillation. In an upper portion 122 of the internal volume 106, the split shell stripper vessel 18 contains a plurality of full diameter fractionation trays 124 above the dividing wall 108.

In an exemplary embodiment, the partially hydrodesulfurized, olefin-enriched naphtha stream 80 is introduced to the vapor-liquid contacting chamber 114 and is fractionated to remove $H_2S$ and form a partially hydrodesulfurized, $H_2S$-depleted, olefin-enriched naphtha stream 126. As will be discussed in further detail below, $H_2S$ removed from the partially hydrodesulfurized, olefin-enriched naphtha stream 80 as well as other light end vapor components (e.g., $C_4^-$ hydrocarbons) collect in the upper portion 122 of the internal volume 106 and form in part a vapor stream 128.

As illustrated, the partially hydrodesulfurized, $H_2S$-depleted, olefin-enriched naphtha stream 126 is removed from the lower portion 112 of the split shell stripper vessel 18 as a liquid stream. In an exemplary embodiment, the partially hydrodesulfurized, $H_2S$-depleted, olefin-enriched naphtha stream 126 has a temperature of from about 200 to about 240° C. The partially hydrodesulfurized, $H_2S$-depleted, olefin-enriched naphtha stream 126 is passed through a heat exchanger 130 and combined with the $H_2$ rich stream 102 to form a combined stream 131. The combined stream 131 is passed through a heat exchanger 132 and a heater 134 and is advanced to the second stage hydrotreating reactor 20. In an exemplary embodiment, the combined stream 131 that includes the partially hydrodesulfurized, $H_2S$-depleted, olefin-enriched naphtha stream 126 is introduced to the second stage hydrotreating reactor 20 at a temperature of from about 250 to about 300° C.

The second stage hydrotreating reactor 20 contains a hydrotreating catalyst as discussed above in relation to the first stage hydrotreating reactor 16. In an exemplary embodiment, the second stage hydrotreating reactor 20 is operating at hydroprocessing conditions that include a temperature of from about 250 to about 300° C. In the second stage hydrotreating reactor 20, the combined stream 131 and the $H_2$ rich stream 100 contact the hydrotreating catalyst to convert at least a substantial portion of the remaining quantity of sulfur from the partially hydrodesulfurized, $H_2S$-depleted, olefin-enriched naphtha stream 126 to $H_2S$ (e.g., via combining the sulfur with hydrogen) to form an additionally hydrodesulfurized, olefin-enriched naphtha stream 136. Also, any nitrogen or nitrogen containing compounds that may be present in the combined stream 131 may be combined with hydrogen to form amines. In an exemplary embodiment, the additionally hydrodesulfurized, olefin-enriched naphtha stream 136 comprises $H_2S$, $C_6$-$C_{12}$ hydrocarbons, olefins, aromatics, and some amines. In an exemplary embodiment, the additionally hydrodesulfurized, olefin-enriched naphtha stream 136 has a temperature of from about 255 to about 305° C.

As illustrated, the additionally hydrodesulfurized, olefin-enriched naphtha stream 136 exits the second stage hydrotreating reactor 20 and is passed through the heat exchangers 130 and 132 for indirect heat exchange with the partially hydrodesulfurized, $H_2S$-depleted, olefin-enriched naphtha stream 126 and the combined stream 131, respectively, and further through a cooler 138 for introduction to a cold separator vessel 140. In an exemplary embodiment, the additionally hydrodesulfurized, olefin-enriched naphtha stream 136 is introduced to the cold separator vessel 140 at a temperature of from about 35 to about 60° C. Light ends such as $H_2$, $C_1$-$C_2$ hydrocarbons, and amines are removed from the additionally hydrodesulfurized, olefin-enriched naphtha stream 136 to form a gas stream 142 and the additionally hydrodesulfurized, olefin-enriched naphtha stream 144. As illustrated, the gas stream 142 is combined with the gas stream 78 for separation in the recycle gas scrubber 22 as discussed above.

The additionally hydrodesulfurized, olefin-enriched naphtha stream 144 is removed from the cold separator vessel 140 and is passed through a heat exchanger 145 and advanced to the split shell stripper vessel 18. In an exemplary embodiment, the additionally hydrodesulfurized, olefin-enriched naphtha stream 144 is introduced to the split shell stripper vessel 18 at a temperature of from about 120 about 145° C.

In an exemplary embodiment, the additionally hydrodesulfurized, olefin-enriched naphtha stream 144 is advanced into the vapor-liquid contacting chamber 116 and is fractionated to remove $H_2S$ and form a hydrodesulfurized, $H_2S$-depleted, olefin-enriched naphtha product stream 146. The hydrodesulfurized, $H_2S$-depleted, olefin-enriched naphtha product stream 146 is removed from the lower portion 112 of the split shell stripper vessel 18 as a liquid product stream.

As mentioned above, $H_2S$ removed from the partially hydrodesulfurized, olefin-enriched naphtha stream 80 and the additionally hydrodesulfurized, olefin-enriched naphtha stream 144 as well as other light end vapor components (e.g., $C_4^-$ hydrocarbons) collect in the upper portion 122 of the internal volume 106 and form the vapor stream 128. In an exemplary embodiment, the vapor stream 128 has a temperature of from about 115 to about 140° C. As illustrated, the vapor stream 128 is passed through a cooler 148 and advanced to a vent separation vessel 150. In an exemplary embodiment, the vapor stream 128 is introduced to the vent separation vessel 150 at a temperature of from about 45 to about 60° C. In the vent separation vessel 150, $H_2S$ and $C_1$-$C_3$ hydrocarbons are removed from the vapor stream 128 to form an offgas stream 152 that comprises $H_2S$ and $C_1$-$C_3$ hydrocarbons and a $C_4^+$ hydrocarbons-containing stream 154. As illustrated, the $C_4^+$ hydrocarbons-containing stream 154 is passed through a pump 156 and returned back to the split shell stripper vessel 18.

Accordingly, apparatuses and methods for desulfurization of naphtha have been described. The exemplary embodiments taught herein provide a naphtha feed stream that comprises sulfur, $C_6$-$C_{12}$ hydrocarbons, olefins, aromatics, and di-olefins. The naphtha feet stream is contacted with a di-olefin hydroprocessing catalyst in the presence of hydrogen at hydrogenation conditions effective to convert di-olefins to olefins and form an olefin-enriched naphtha stream. The olefin-enriched naphtha stream is advanced into a first stage hydrotreating reactor that contains a hydrotreating catalyst in the presence of hydrogen and that is operating at hydroprocessing conditions effective to convert a quantity of sulfur into $H_2S$ and form a partially hydrodesulfurized, olefin-enriched naphtha stream. The partially hydrodesulfurized, olefin-enriched naphtha stream is introduced to a first vapor-liquid contacting chamber of a split shell stripper vessel for fractionation to form a partially hydrodesulfurized, $H_2S$-depleted, olefin-enriched naphtha stream. The partially hydrodesulfurized, $H_2S$-depleted, olefin-enriched naphtha stream is advanced into a second stage hydrotreating reactor that contains a hydrotreating catalyst in the presence of hydrogen and that is operating at second hydroprocessing conditions effective to convert an additional quantity of sulfur to $H_2S$ and form an additionally hydrodesulfurized, olefin-enriched naphtha stream. The additionally hydrodesulfurized, olefin-enriched naphtha stream is introduced to a second vapor-liquid contacting chamber of the split shell stripper vessel for fractionation to form a hydrodesulfurized, $H_2S$-depleted, olefin-enriched naphtha product stream.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A method for desulfurization of naphtha, the method comprising the steps of:

contacting a naphtha feed stream with a di-olefin hydroprocessing catalyst in the presence of hydrogen at hydrogenation conditions effective to convert di-olefins and form an olefin-enriched naphtha stream;

advancing the olefin-enriched naphtha stream into a first hydrotreating reactor that contains a first hydrotreating catalyst in the presence of hydrogen and that is operating at first hydroprocessing conditions effective to convert a quantity of sulfur into H2S and form a partially hydrodesulfurized, olefin-enriched naphtha stream, the first hydroprocessing conditions including a temperature of from about 250 to about 300° C.;

separating H2, C1-C2 hydrocarbons, and a portion of H2S from the partially hydrodesulfurized, olefin-enriched naphtha stream at a temperature of from about 35 to about 60° C.;

fractionating the partially hydrodesulfurized, olefin-enriched naphtha stream in a first vapor-liquid contacting chamber to form a partially hydrodesulfurized, H2S-depleted, olefin-enriched naphtha stream, wherein the partially hydrodesulfurized, olefin-enriched naphtha stream is introduced into the first vapor-liquid contacting chamber at a temperature of from about 120 to about 145° C.;

contacting the partially hydrodesulfurized, H2S-depleted, olefin-enriched naphtha stream with a hydrotreating catalyst in the presence of hydrogen at hydroprocessing conditions effective to form an additionally hydrodesulfurized, olefin-enriched naphtha stream, the hydroprocessing conditions including a temperature of about 250 to about 300° C.; and fractionating the additionally hydrodesulfurized, olefin-enriched naphtha stream in a second vapor-liquid contacting chamber to form a hydrodesulfurized, H2S-depleted, olefin-enriched naphtha product stream, wherein the first and second vapor-liquid contacting chambers are enclosed in a split shell stripper vessel and separated by a dividing wall, and wherein the additionally hydrodesulfurized, olefin-enriched naphtha stream is introduced to the second vapor-liquid contacting chamber at a temperature of from about 120 to about 145° C.

2. The method of claim 1, wherein the partially hydrodesulfurized, H2S-depleted, olefin-enriched naphtha stream exits the first vapor-liquid contacting chamber at a temperature of from about 200 to about 240° C.

3. The method of claim 1, wherein the hydrodesulfurized, H2S-depleted, olefin-enriched naphtha product stream exits the first vapor-liquid contacting chamber at a temperature of from about 200 to about 240° C.

4. The method of claim 1, further comprising the step of: separating H2, C1-C2 hydrocarbons, and a portion of H2S from the additionally hydrodesulfurized, olefin-enriched naphtha stream prior to the step of fractionating the additionally hydrodesulfurized, olefin-enriched naphtha stream.

5. The method of claim 4, wherein the step of separating comprises separating H2, C1-C2 hydrocarbons, and the portion of H2S from the additionally hydrodesulfurized, olefin-enriched naphtha stream at a temperature of from about 35 to about 60° C.

6. A method for desulfurization of naphtha, the method comprising the steps of:

contacting a naphtha feed stream that comprises sulfur, C6-C12 hydrocarbons, olefins, aromatics, and di-olefins with a di-olefin hydroprocessing catalyst in the presence of hydrogen at hydrogenation conditions effective to convert di-olefins to olefins and form an olefin-enriched naphtha stream;

advancing the olefin-enriched naphtha stream into a first hydrotreating reactor that contains a first hydrotreating catalyst in the presence of hydrogen and that is operating at first hydroprocessing conditions effective to convert a quantity of sulfur into H2S and form a partially hydrodesulfurized, olefin-enriched naphtha stream, the first hydroprocessing conditions including a temperature of from about 250 to about 300° C.;

cooling the partially hydrodesulfurized, olefin-enriched naphtha stream to a temperature of from about 35 to about 60° C. to form a cooled partially hydrodesulfurized, olefin-enriched naphtha stream; and introducing the cooled partially hydrodesulfurized, olefin-enriched naphtha stream to a first cold separator for separating H2, C1-C2 hydrocarbons, and a portion of H2S from the cooled partially hydrodesulfurized, olefin-enriched naphtha stream;

introducing the partially hydrodesulfurized, olefin-enriched naphtha stream to a first vapor-liquid contacting chamber of a split shell stripper vessel for fractionation to form a partially hydrodesulfurized, H2S-depleted, olefin-enriched naphtha stream, wherein the partially hydrodesulfurized, olefin-enriched naphtha stream is introduced into the first vapor-liquid contacting chamber at a temperature of from about 120 to about 145° C.;

advancing the partially hydrodesulfurized, H2S-depleted, olefin-enriched naphtha stream into a second hydrotreating reactor that contains a second hydrotreating catalyst in the presence of hydrogen and that is operating at second hydroprocessing conditions effective to convert an additional quantity of sulfur to H2S and form an additionally hydrodesulfurized, olefin-enriched naphtha stream, the second hydroprocessing conditions including a temperature of about 250 to about 300° C.; and introducing the additionally hydrodesulfurized, olefin-enriched naphtha stream to a second vapor-liquid contacting chamber of the split shell stripper vessel for fractionation to form a hydrodesulfurized, H2S-depleted, olefin-enriched naphtha product stream, wherein the first and second vapor-liquid contacting chambers are separated by a dividing wall that extends vertically in an internal volume enclosed by the split shell stripper vessel, and wherein the additionally hydrodesulfurized, olefin-enriched naphtha stream is introduced to the second vapor-liquid contacting chamber at a temperature of from about 120 to about 145° C.

7. The method of claim 6, wherein the step of contacting the naphtha feed stream comprises contacting the naphtha feed stream with the di-olefin hydroprocessing catalyst at the hydrogenation conditions that include a temperature of from about 130 to about 180° C.

8. The method of claim 6, further comprising the step of: heating the olefin-enriched naphtha stream for advancing into the first hydrotreating reactor.

9. The method of claim 6, further comprising the steps of:

removing the cooled partially hydrodesulfurized, olefin-enriched naphtha stream from the first cold separator; and heating the cooled partially hydrodesulfurized, olefin-enriched naphtha stream to form a heated partially hydrodesulfurized, olefin-enriched naphtha stream, and wherein the step of introducing the partially hydrodesulfurized, olefin-enriched naphtha stream comprises introducing the heated partially hydrodesulfurized, olefin-enriched naphtha stream to the first vapor-liquid contacting chamber of the split shell stripper vessel to form the partially hydrodesulfurized, H2S-depleted, olefin-enriched naphtha stream.

10. The method of claim 6, further comprising the step of:

cooling the additionally hydrodesulfurized, olefin-enriched naphtha stream to form a cooled additionally hydrodesulfurized, olefin-enriched naphtha stream; and introducing the cooled additionally hydrodesulfurized, olefin-enriched naphtha stream to a second cold separator for separating H2, C1-C2 hydrocarbons, and a portion of H2S from the cooled additionally hydrodesulfurized, olefin-enriched naphtha stream prior to the step of introducing to the second vapor-liquid contacting chamber.

11. The method of claim 10, wherein the step of cooling comprises cooling the additionally hydrodesulfurized, olefin-enriched naphtha stream to a temperature of from about 35 to about 60° C. to form the cooled additionally hydrodesulfurized, olefin-enriched naphtha stream.

* * * * *